US006094948A

United States Patent [19]

Hong et al.

[11] Patent Number: 6,094,948

[45] Date of Patent: Aug. 1, 2000

[54] WASHING MACHINE WITH AN AIR BUBBLE GENERATOR

[75] Inventors: Dae-Yeong Hong, Incheon; Moo-Saeng Lim, Seoul, both of Rep. of Korea

[73] Assignee: Daewoo Electronics Co., Ltd., Seoul, Rep. of Korea

[21] Appl. No.: 09/187,984

[22] Filed: Nov. 9, 1998

[30] Foreign Application Priority Data

Jul. 29, 1998 [KR] Rep. of Korea ..... 98-30725

[51] Int. Cl.[7] ..... D06F 21/04; D06F 37/00

[52] U.S. Cl. ..... 68/183; 261/122.1

[58] Field of Search ..... 68/183; 134/102.1, 134/102.2; 261/122.1

[56] References Cited

U.S. PATENT DOCUMENTS

| | | | |
|---|---|---|---|
| 1,172,296 | 2/1916 | Lester | 68/183 X |
| 2,637,541 | 5/1953 | Rubin | 261/122.1 |
| 4,606,867 | 8/1986 | Eguchi | 261/122.1 |
| 5,253,380 | 10/1993 | Lim et al. . | |
| 5,295,373 | 3/1994 | Lim et al. . | |
| 5,307,649 | 5/1994 | Lim et al. . | |

FOREIGN PATENT DOCUMENTS

| | | | |
|---|---|---|---|
| 493342 | 3/1930 | Germany | 261/122.1 |
| 3535016 | 4/1987 | Germany . | |
| 36482 | 11/1970 | Japan | 261/122.1 |

*Primary Examiner*—Philip R. Coe
*Attorney, Agent, or Firm*—Jacobson, Price, Holman & Stern, PLLC

[57] ABSTRACT

An air bubble generator for a washing machine has an open box-type case, a porous member, and a plate. The open box-type case has an inlet in the bottom thereof for a passageway of compressed air and space therein for accommodating the compressed air. The porous member provides the accommodated compressed air with passageways. The plate fixedly covers the open box-type case and has through-holes therein. The plate provides air bubbles in the washing water. The porous member has a plurality of compartments symmetrically arranged with respect to each other. The plurality of compartments are arranged along the upper surface of the porous member. Each of the plurality of compartments is spaced apart from the bottom of the case.

1 Claim, 12 Drawing Sheets

WASHING MACHINE WITH AN AIR BUBBLE GENERATOR

BACKGROUND OF THE INVENTION

1. Field of the Invention

The present invention relates to a washing machine, and more particularly to a washing machine of a drum type with an air bubble generator capable of evenly dispersing air bubbles throughout washing water in a washer tub.

2. Description of the Prior Art

In general, the washing machines are classified into two categories. The first one of the two categories includes a whirl-type washing machine in which washing articles are washed by a vortex flow of washing water formed in a washer tub when a pulsator is rotated. The second one includes a drum-type washing machine. The drum-type washing machine has a rotary drum a portion of which lies in the washing water. In such a rotary drum, the washing articles are put in the rotary drum. When the rotary drum is rotated, the washing articles in the rotary drum strike each other, so that the washing articles are washed.

In order to enhance washing efficiency of the drum-type washing machine, an air bubble generator for the drum-type washing machine is proposed. FIG. 1 is a schematic view of a conventional drum-type washing machine with an air bubble generator, FIG. 2 is an enlarged perspective view of the rotary drum of FIG. 1, and FIG. 3 is an enlarged perspective view of the air bubble generator of FIG. 1.

Hereinafter, the conventional drum-type washing machine with an air bubble generator will be described with reference to accompanying drawings.

In general, a drum-type washing machine includes a housing (10) and a washer tub mounted in the housing (10) to accommodate washing water. The shaft (not shown) of the rotary drum (30) is mounted parallel to the surface of the washing water. A portion of the rotary drum (30) is sunk in the washing water. The rotary drum (30) has a plurality of through-holes (32). The through-holes (32) are formed in a certain pattern for the washing water to flow in and out of the rotary drum (30).

The surface of the rotary drum (30) is formed with four backward curved vane-type latches (34). Each of the four backward curved vane-type latches (34) has a latch surface (36) which continuously increases its height in a radial direction forwardly from the beginning to the end of the latch surface (36). The four backward curved vane-type latches (34) are each spaced apart in a certain distance along the surface of the rotary drum (30). The end of the latch surface (36) has two plate-shaped latch edges (37) at both side ends protruding in a radial direction. A slit between the two latch edges (37) is formed to backwardly decrease its height in a radial direction, and the slit is wide enough for air bubbles to pass through and into the rotary drum (30) from the washing water.

The air bubble generator (40) is disposed over the bottom of washer tub and connected with an air pump (not shown) through a conduit (42). The air bubble generator (40) is operated to supply a certain amount of air bubbles periodically and at one time into the rotary drum (30). The air bubble generator (40) is completely sunk in the washing water. As shown in FIG. 3, the air bubble generator (40) is constituted with a coverless box-type case (44) and an air bubble-generating plate (48). The air bubble-generating plate (48) covers the box-type case (44), to thereby form space between them. The case (44) prevents air flowing in through the conduit (42) from flowing out of the air bubble generator (40) except through the air bubble-generating plate (48). An inlet (45) with which the conduit (42) is connected is provided in the bottom of the case (44). A porous member (46) is mounted between the case (44) and the air bubble-generating plate (48). The air bubble-generating plate (48) has a plurality of through-holes (49) for supplying air bubbles into the washing water. The plurality of through-holes (49) are small enough in diameter for an air bubble to maintain its shape.

Hereinafter, operations of a conventional air bubble generator as mentioned above will be described.

The porous member (46) in the case (44) under the washing water passes air flowing in through the inlet (45) onto the air bubble-generating plate (48). The air bubbles from the air bubble-generating plate (48) go up directly through the porous member (46). Only a small amount of air bubbles from the porous member (46) passes through the through-holes (49) onto the rotary drum (30). However, most of the air bubbles from the porous member (46) move along the lower side of the air bubble-generating plate (48) into the sides thereof because of a water membrane formed in each of the through-holes (49). The air, from the air bubbles, gathered under the sides of the air bubble-generating plate (48) is stuck by the sides of the case (44) and passes through the porous member (46) and the air bubble-generating plate (48) toward the rotary drum (30). The air bubbles from the through-holes (49) flow into the washing water in the rotary drum (30) through the slit (38) as the rotary drum (30) is rotated. The air bubbles in the washing water serve to wash washing articles.

However, in the conventional air bubble generator, more air bubbles are generated from the sides of the air bubble-generating plate compared to those from the air bubble-generating plate except the sides. Accordingly, the amount of air bubbles does not flow evenly in the rotary drum as the rotary drum is rotated, to thereby reduce washing efficiency.

Further, in a washing machine with the conventional air bubble generator, since the rotary drum is mounted far apart from the sides of the air bubble generator, the air bubbles are likely to disappear in the washing water before reaching the rotary drum.

SUMMARY OF THE INVENTION

It is the first object of the present invention to provide a washing machine with an air bubble generator capable of evenly generating air bubbles.

It is the second object of the present invention to provide a washing machine with an air bubble generator capable of enhancing washing efficiency for washing articles.

It is the third object of the present invention to provide a washing machine with an air bubble generator capable of providing more air bubbles which reach washing articles.

In order to achieve the objects, a washing machine with an air bubble generator generates air bubbles from air into washing water in a washer tub. The washing machine has a rotary drum for washing. The air bubble generator comprises an open box-type case. The open box-type case has an inlet in the bottom thereof for a passageway of compressed air and space therein for accommodating the compressed air. A porous member provides the accommodated compressed air with passageways. An air bubble-generating plate (hereinafter, called "a plate") fixedly covers the open box-type case and has through-holes therein, and provides air bubbles in the washing water. The plate has the same curvature as the curvature of the rotary drum. The porous member has a plurality of compartments symmetrically arranged about the inlet. The plurality of compartments are arranged along the upper surface of the porous member. Each of the plurality of compartments is spaced apart from the bottom of the case. The plurality of compartments are constituted with an array of pairs of compartments, that is, a first pair of compartments, a second pair of compartments, and a third pair of compartments. The first pair of compartments protrude to be arranged along the lower surface of the plate and to be spaced apart from the bottom of the case in a first distance. The second pair of compartments protrude to be arranged in parallel with the first pair of compartments and to be spaced apart from the bottom of the case in a second distance. The third pair of compartments protrude to be arranged in parallel with the second pair of compartments and to be spaced apart from the bottom of the case in a third distance, wherein the first distance is larger than the second distance and the second distance is larger than the third distance. The plurality of compartments are five pairs of compartments. The five pairs of compartments protrude to be arranged along the lower surface of the plate and to be spaced apart from the bottom of the case in the same distance. The interval between the compartments becomes less in directions from a center portion to opposite edge portions of the plate. In the meantime, the plate may have a plurality of ribs along the lower surface thereof to provide air bubbles in the washing water. Each of the plurality of ribs has the same length and is spaced apart from the bottom of the case, the plurality of the ribs are constituted with a plurality of front ribs and a plurality of back ribs. The plurality of front ribs and the plurality of back ribs are arranged in an alternate manner. The interval between the plurality of ribs becomes less in directions from one edge to another edge of the plate.

BRIEF DESCRIPTION OF THE DRAWINGS

These and other objects and features of the present invention can be understood through the following embodiment with reference to the accompanying drawings, in which.

DETAILED DESCRIPTION OF THE PREFERRED EMBODIMENTS

Hereinafter, an air bubble generator according to referred embodiments of the present invention with reference to FIGS. 4–12 will be described.

The First Embodiment

Figure 1:
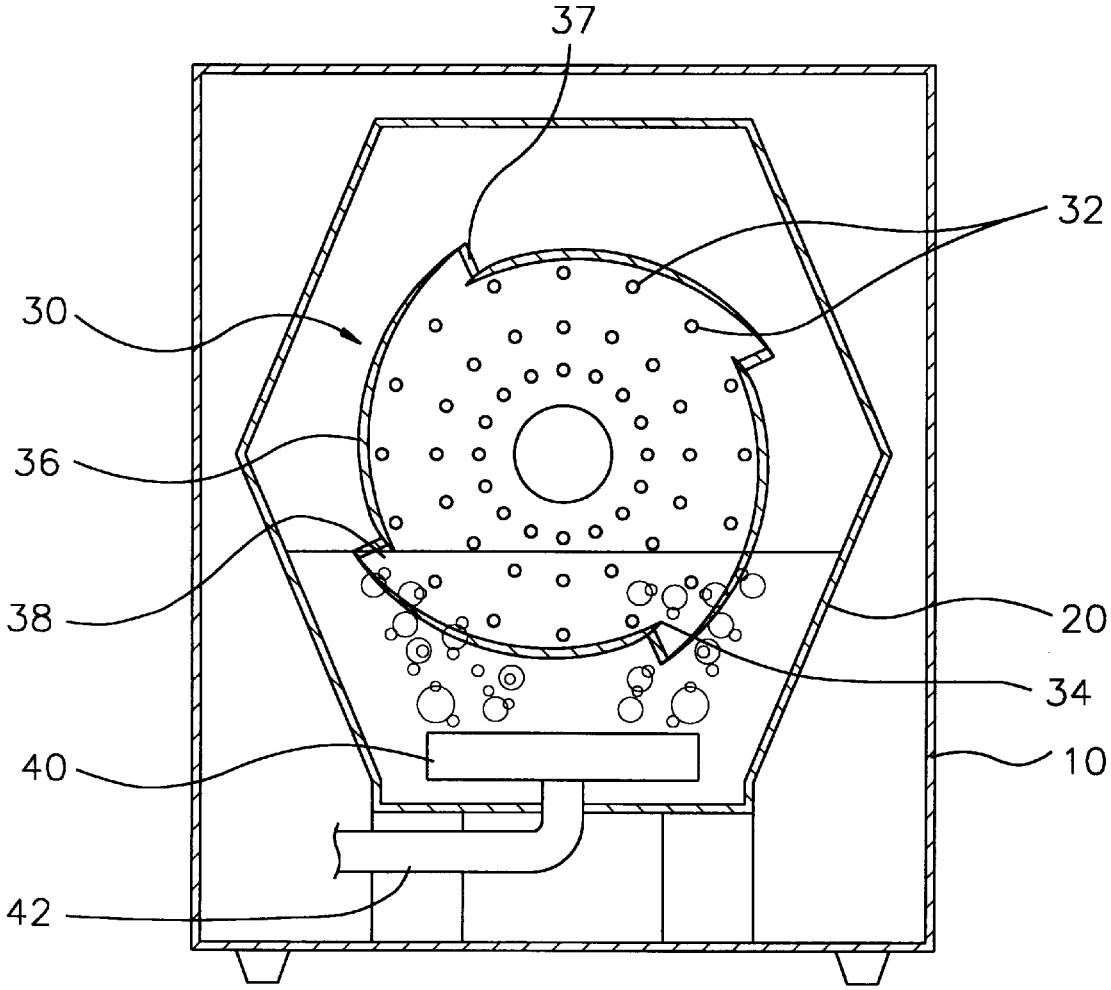
FIG. 1 PRIOR ART
FIG. 1 is a schematic view of a conventional drum-type washing machine with an air bubble generator.
Figure 2:
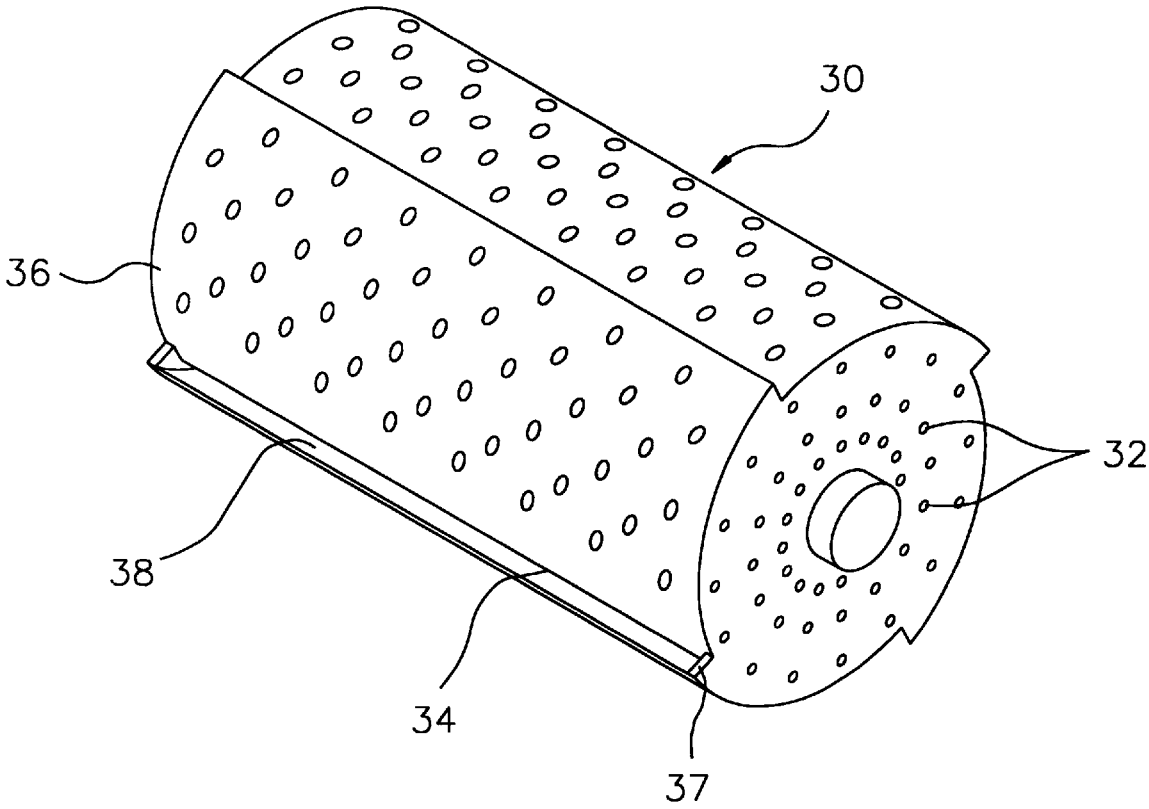
FIG.2 PRIOR ART
FIG. 2 is an enlarged perspective view of the rotary drum of FIG. 1.
Figure 3:
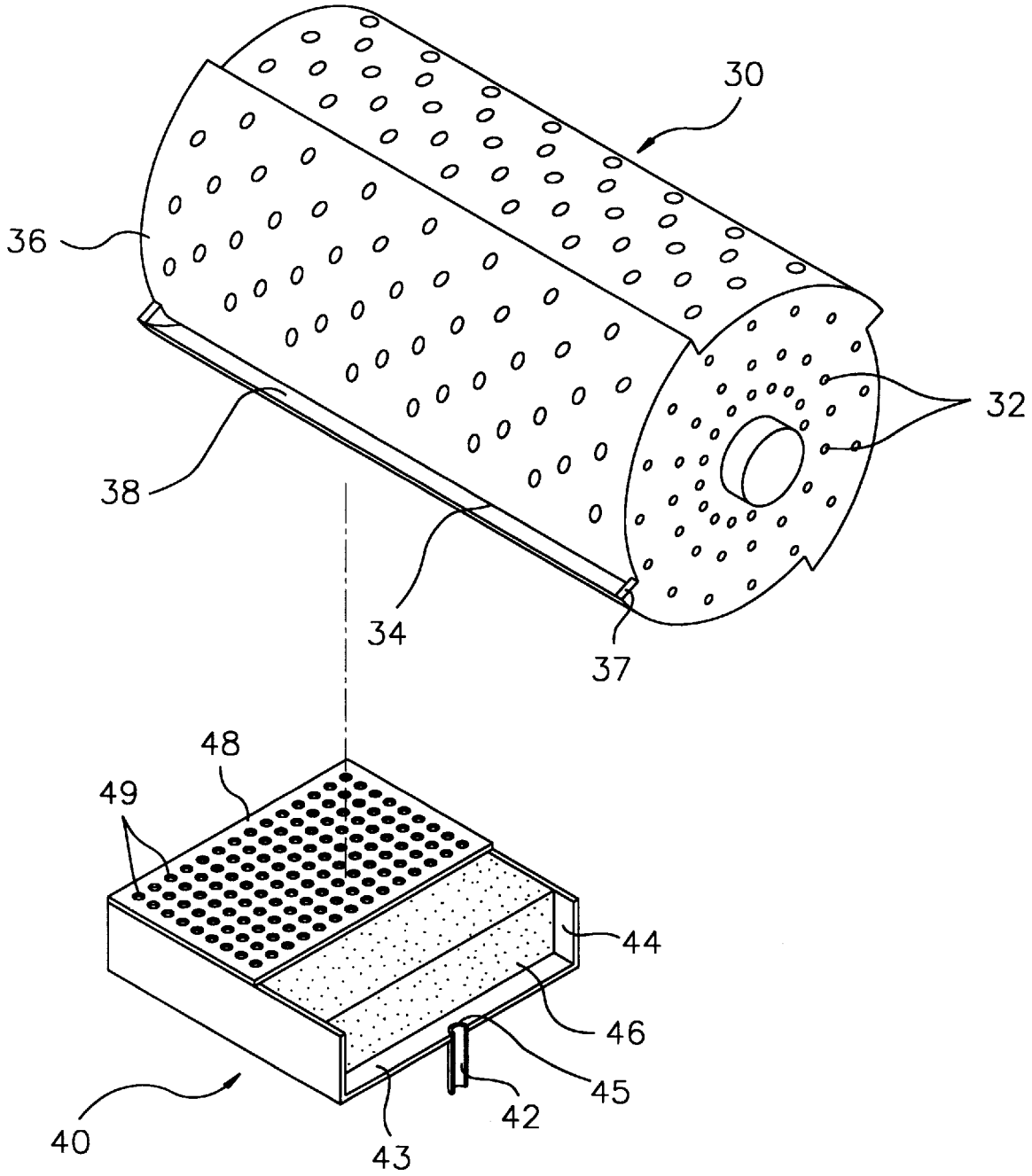
FIG.3 PRIOR ART
FIG. 3 is an enlarged perspective view of the air bubble generator of FIG. 1.
Figure 4:
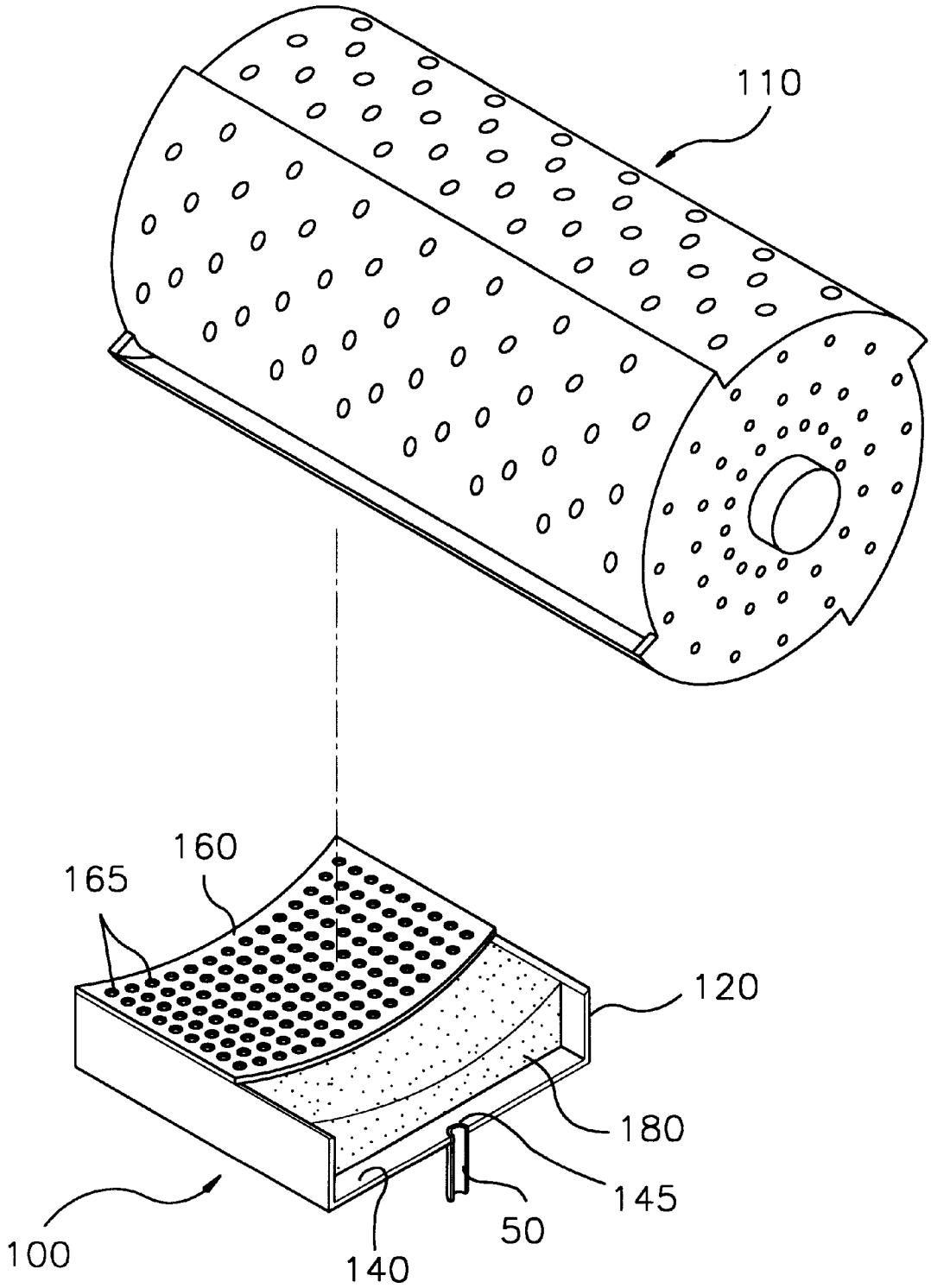
FIG. 4 shows perspective views of an air bubble generator and a rotary drum according to the first embodiment of the present invention.

An air bubble generator 100 as shown in FIG. 4 is constituted with a case 120, a porous member 180, and an air bubble-generating plate (hereinafter, called "a plate") 160. The air bubble generator 100 has space between the case 120 and the plate 160. The porous member 180 is mounted in the space. The bottom 140 of the case 120 has an inlet 145 connected with a conduit 50 which is a passageway for compressed air. The plate 160 has a plurality of through-holes 165. The plate 160 is curved to have the same curvature as that of a rotary drum 110. Accordingly, the distance between the outer surface of a rotary drum 110 and the air bubble generator 100 becomes uniform. Further, the height from the bottom of the case 120 to each end of the two edges, for example, each end of the left and right edges, of the plate 160 is larger than that from the bottom of the case 120 to the portion of the plate 160 opposite to the inlet 145.

Operations of the air bubble generator 100 will be described hereinafter.

Air from an air compressor (not shown) flows in the air bubble generator 100 through the conduit 50. The air in the air bubble generator 100 passes through the porous member 180 completely sunk in the washing water and up to the plate 160. The air reaching to the plate 160 may be transmitted in the shape of air bubbles, and passes through the through-holes 165 into the washing water. The air bubbles from the plate 160 flow in the rotary drum (hereinafter, called "drum") 110 together with the washing water as the drum 110 is rotated. The air bubbles in the drum 110 serve to wash washing articles.

In the air bubble generator according to the first embodiment of the present invention, the drum has the same curvature as that of the plate 160. That is, since the distance between the drum and the plate are the same all the time, air bubbles from the plate can flow in the drum at the same rate all the time irrespectively of a generation position of the air bubbles, to thereby enhance washing efficiency.

The Second Embodiment

Figure 5:
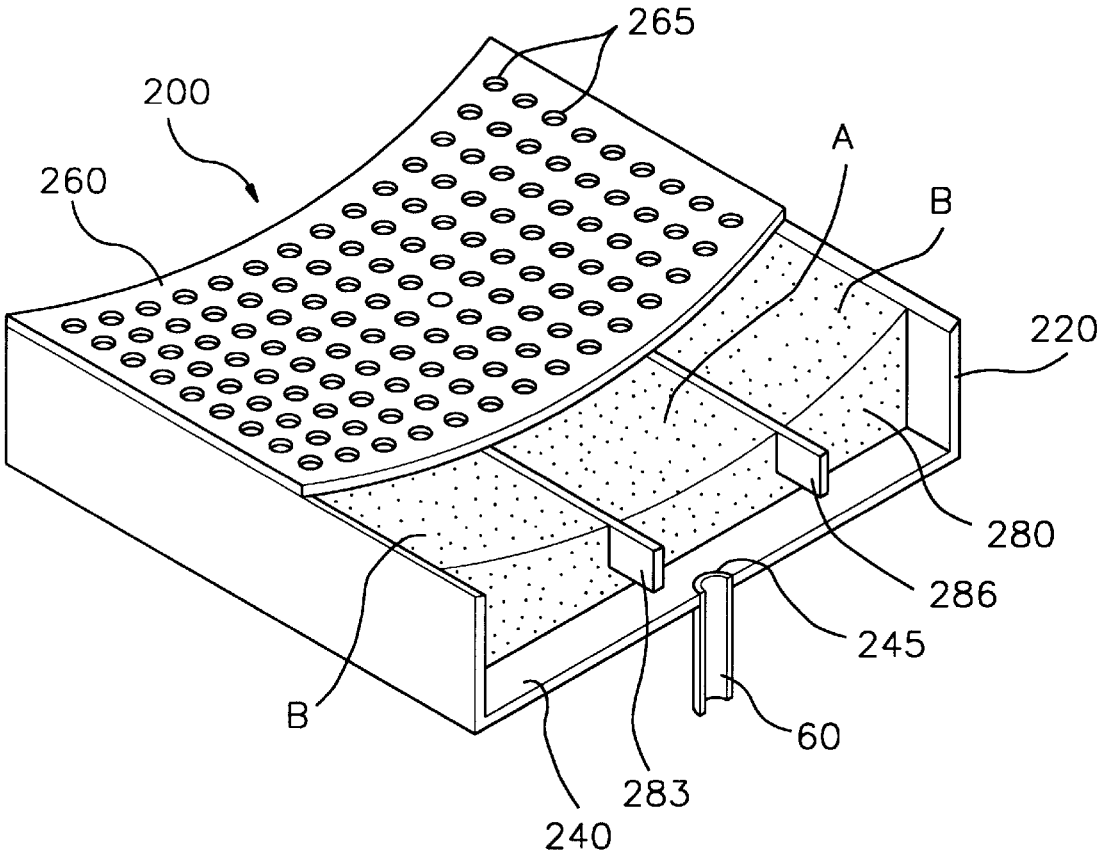
FIG. 5 is a perspective view of an air bubble generator according to the second embodiment of the present invention.
Figure 6:
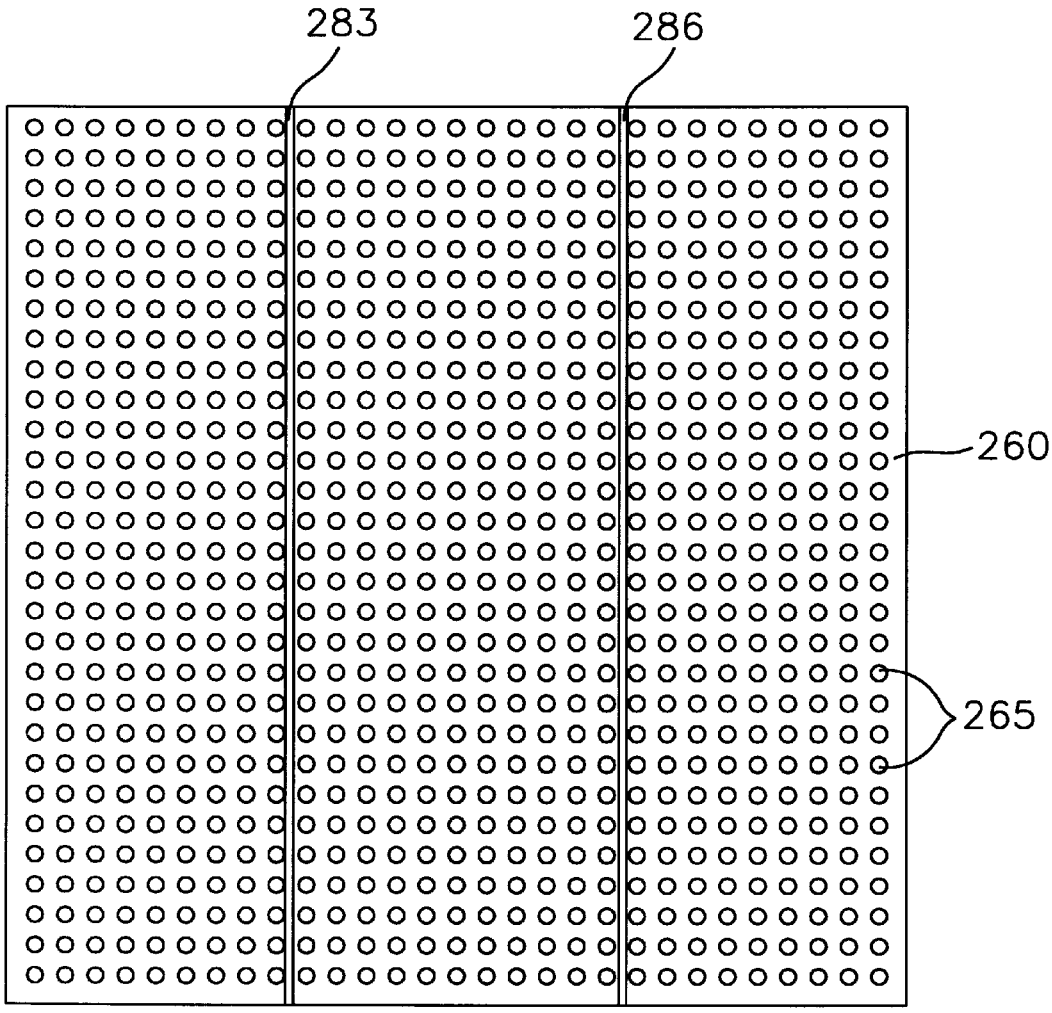
FIG. 6 is a top view of an air bubble-generating plate according to the second embodiment of the present invention.

An air bubble generator 200 as shown in FIG. 5 is constituted with a case 220, a porous member 280, and an air bubble-generating plate (hereinafter, called "a plate") 260. The air bubble generator 200 has space between the case 220 and the plate 260. The porous member 280 is mounted in the space. The bottom 240 of the case 220 has an inlet 245 connected with a conduit 60 which is a passageway of compressed air. The plate 260 has a plurality of through-holes 265. The plate 260 is made with the same process as the first embodiment. The porous member 280 has a pair of compartments 283 and 286 to divide the porous member 280 into a center portion A and side portions B. The positions of the compartments 283 and 286 are determined to evenly generate air bubbles throughout the center portion A and each of the side portions B. The compartments 283 and 286 are apaced apart from the bottom 240 of the case 220. The upper portion of each of the compartments 283 and 286 is in contact with the lower surface of the plate 260. The compartments 283 and 286 are mounted between the columns of through-holes 265. The upper portions of the compartments 283 and 286 are arranged to have the same distance from the shaft of the drum as shown in FIG. 4. Further, the lower portions of the compartments 283 and 286 are arranged to have the same distance from the bottom 240 of the case 220. The length of each of the compartments 283 and 286 is the same as the length of the plate 260, as shown in FIG. 6.

Operations of the air bubble generator 200 according to the second embodiment of the present invention will be described hereinafter.

Air from an air compressor (not shown) flow in the air bubble generator 200 through the conduit 60. The air in the air bubble generator 200 passes through the porous member 280 sunk in the washing water and up to the plate 260. The air in the air bubble generator 200 flow toward the plate 260. As the air reaches the lower surface of the plate 260, the air moves along the lower surface of the plate 260 to the edge portions B, for example, the left and right edge portions, of the plate 260. As the moving air reaches the compartments 283 and 286, a part of the moving air is prevented from moving further by the compartments 283 and 286 so as to remain in the center portion A. The rest of the moving air keeps moving toward the edge portions B by passing by the compartments 283 and 286. Accordingly, the remaining air in the center portion A flows out of the through-holes 265 in the center portion of the plate 260 as air bubbles.

In the meantime, air directly from the inlet 245 and air from the center portion A gather together in the edge portions B. The air in the edge portions B flows out of the through-holes 265 in the edge portions B of the plate 260 into the washing water.

In the air bubble generator according to the second embodiment of the present invention, the porous member with compartments inserted in parallel to each other is mounted apart from the bottom of the case, and contacted with the plate. Accordingly, air from a compressor flows in through the inlet, and the flow-in air is supplied in the center portion A and the edge portions B of the plate in a certain ratio by the compartments. Accordingly, the air bubbles from the plate are evenly distributed.

The Third Embodiment

Figure 7:
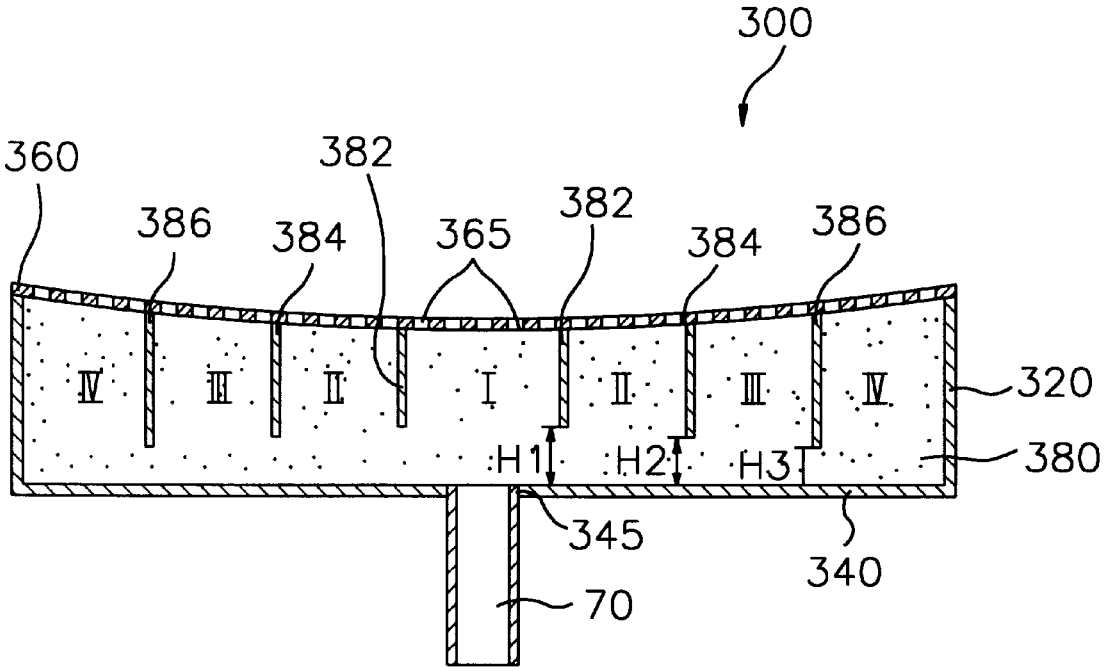
FIG. 7 is a vertically cross-sectioned view of an air bubble generator according to the third embodiment of the present invention.
Figure 8:
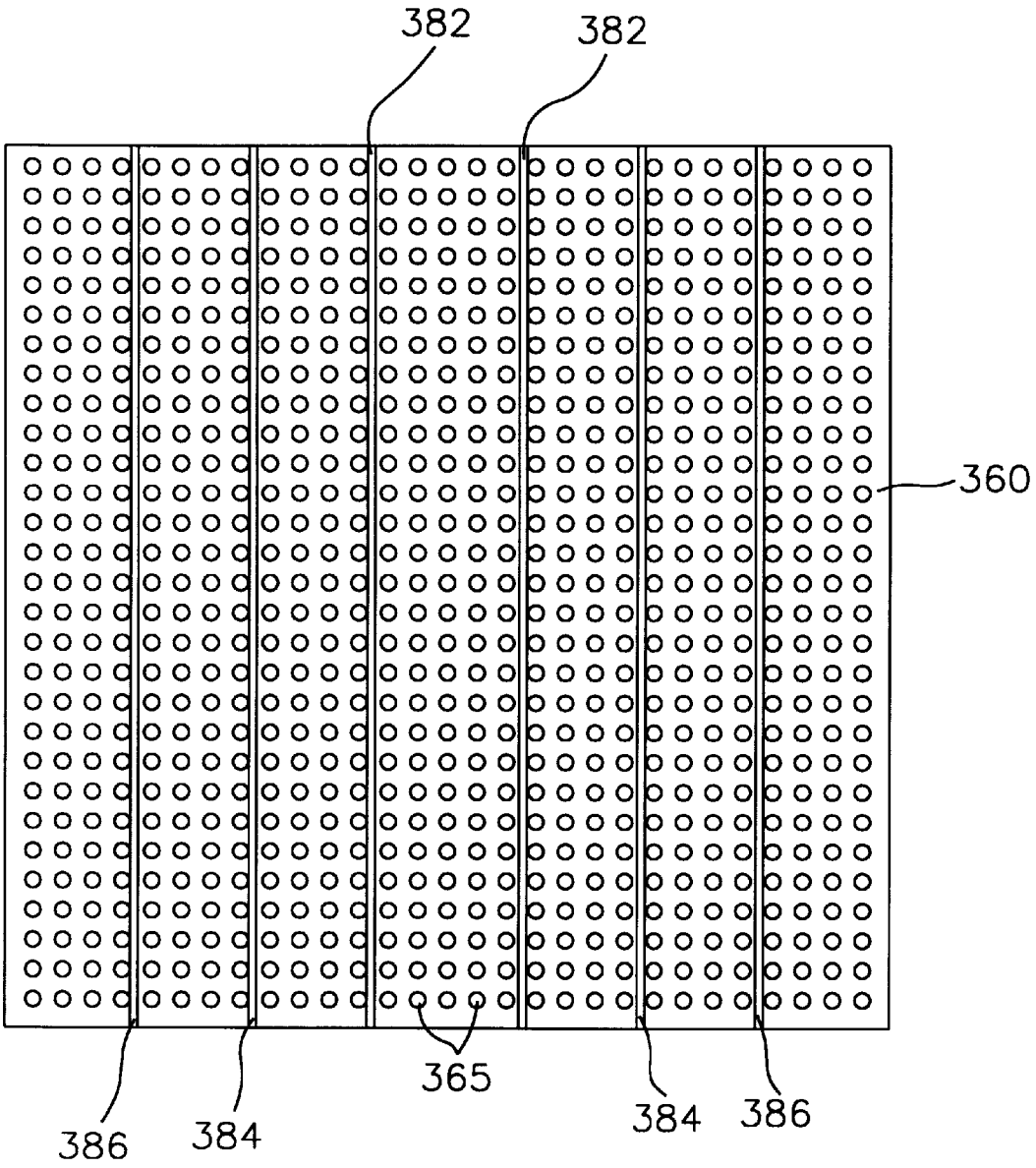
FIG. 8 is a top view of an air bubble-generating plate according to the third embodiment of the present invention.
Figure 9:
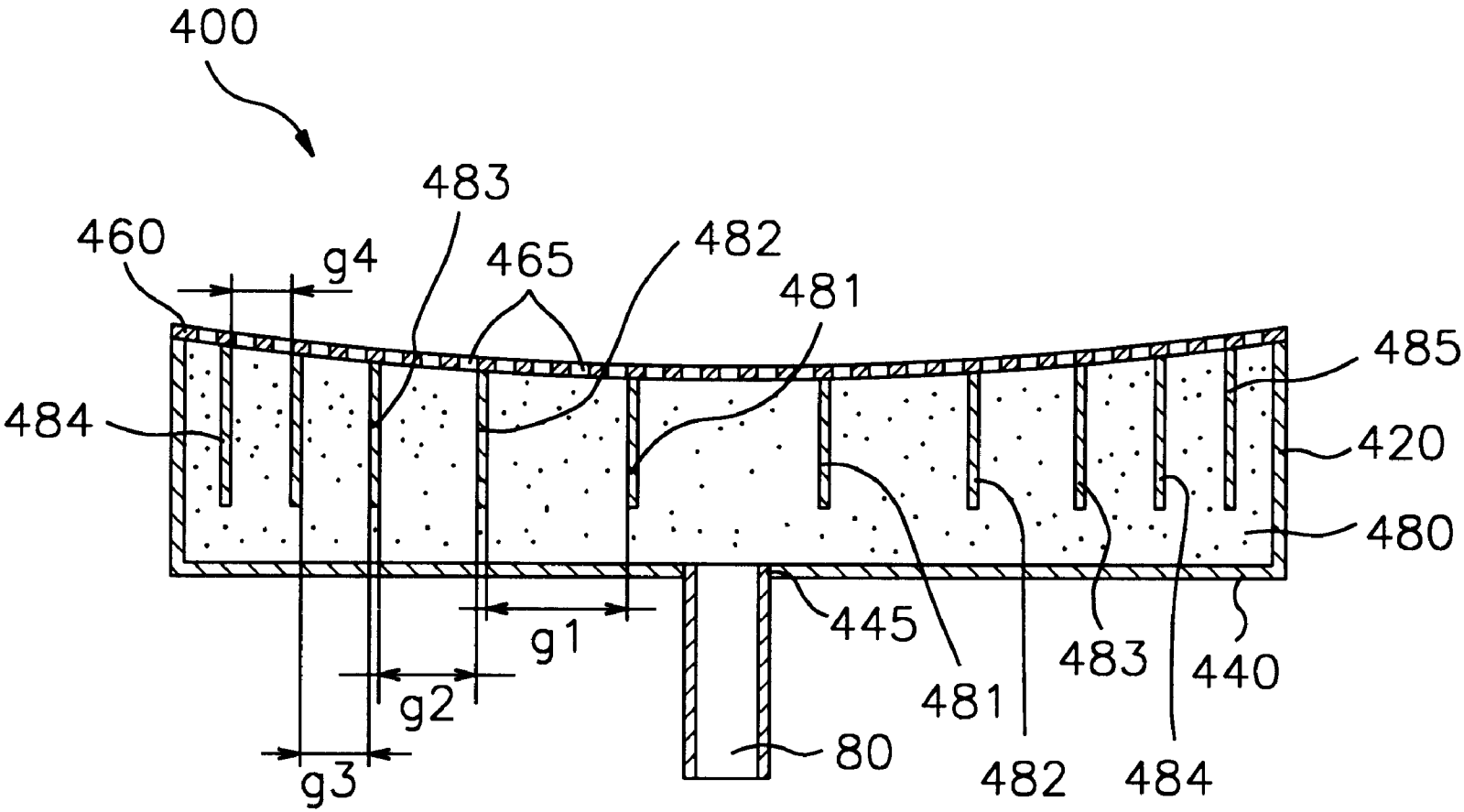
FIG. 9 is a vertically cross-sectioned view of an air bubble generator according to the fourth embodiment of the present invention.

As shown in FIG. 7, an air bubble generator 300 is adapted to more evenly regulate the distribution of air bubbles from the plate. The air bubble generator 300 is constituted with a case 320, a porous member 380, and an air bubble-generating plate (hereinafter, called "a plate") 360. The air bubble generator 300 has space between the case 320 and the plate 360. The porous member 380 is mounted in the space. The bottom 340 of the case 320 has an inlet 345 connected with a conduit 70 which is a passageway of compressed air (not shown). The plate 360 has a plurality of through-holes 365. The plate 360 is made with the same process as the first embodiment. The porous member 380 has first compartments 382, 382, second compartments 384, 384, and third compartments 386, 386. Each of the first, second, and third compartments is spaced apart from the bottom 340 of the case 320. Each upper portion of the compartments is contacted with the lower surface of the plate 360, and is disposed between columns of the through-holes 365. The upper portions of the compartments are arranged to have the same distance from the shaft of the drum. As shown in FIG. 8, the intervals between the compartments are the same. The space in the case 320 is divided by the compartments as a first section I, a second section II, a third section III, and a fourth section IV. The distance from the bottom 340 to each of the compartments 382, 384, and 386 is determined for air bubbles to be evenly generated from each of the sections of the plate 360. A distance H2 from the bottom 340 of the case 320 to the end of the second compartment 384 is shorter than a distance Hl from the bottom 340 to the end of the first compartment 382. A distance H3 from the bottom 340 to the end of the third compartment 386 is shorter than the distance H2 from the bottom 340 to the end of the second compartment 384.

Operations and effect of the air bubble generator 300 according to the third embodiment of the present invention will be described hereinafter.

Air from an air compressor (not shown) flows in the air bubble generator 300 through the conduit 70. The air in the air bubble generator 300 passes through the porous member 380 sunk in the washing water up to the plate 360. The air flowing in the air bubble generator 380 is distributed to the first section I, the second section II, the third section III, and the fourth section IV by the first compartments 382, the second compartments 384, and the third compartments 386. At this time, more air flows in the first section I than the other sections II and III. As the air in the first section I reaches the lower surface of the plate 360, the air moves along the lower surface of the plate 360. As the moving air meets the first compartments 382, a part of the air remains in the first section I because of the height of the first compartments 382, the rest of the air moves to the second section II by passing the first compartments 382. As the air flowing in the second section II reaches the plate 360, the air moves along the lower surface of the plate 360 until the air meet the second compartments 384. In the same manner as in the first section I, a part of the air flowing in the second section II comes out of the through-holes 365, and the rest of the air keeps moving to the third section III. When the air in the third section III reaches the plate 360, the air moves along the lower surface of the plate 360 until the air meets the third compartments 386. As in the first section I, a part of the air in the third section III comes out of the through-holes 365, and the rest of the air moves to the fourth section IV.

The air bubble generator according to the third embodiment of the present invention varies in distances from the bottom to the lower ends of the compartments for regulation of air flow. Accordingly, as the air in the air bubble generator passes the sections, a quantity of air can be regulated. Since the distribution of air in the air bubble generator is regulated by the compartments, a quantity of air bubbles coming out of the plate can be evenly regulated.

The Fourth Embodiment

Figure 10:
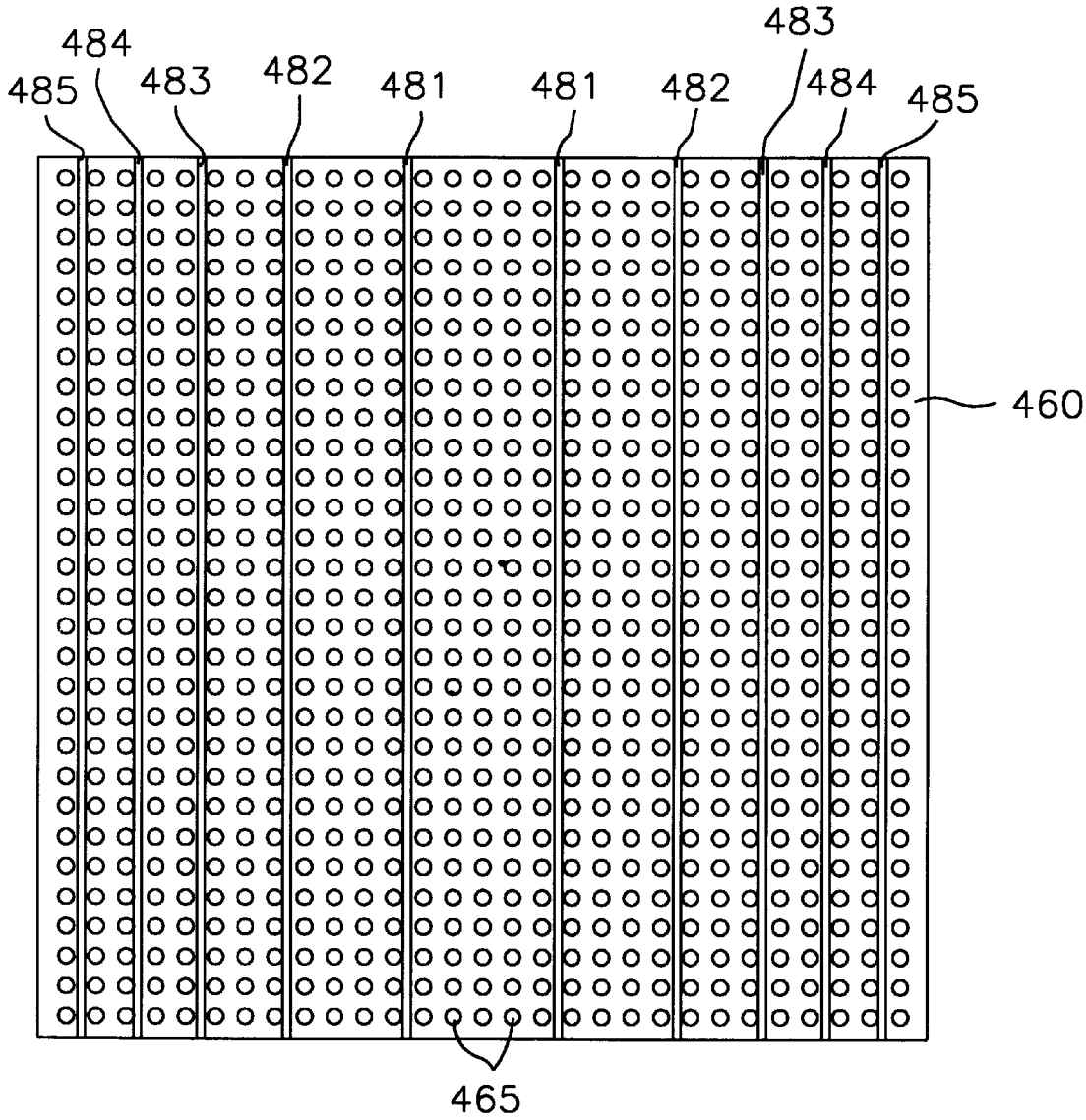
FIG. 10 is a top view of an air bubble-generating plate according to the fourth embodiment of the present invention.
Figure 11:
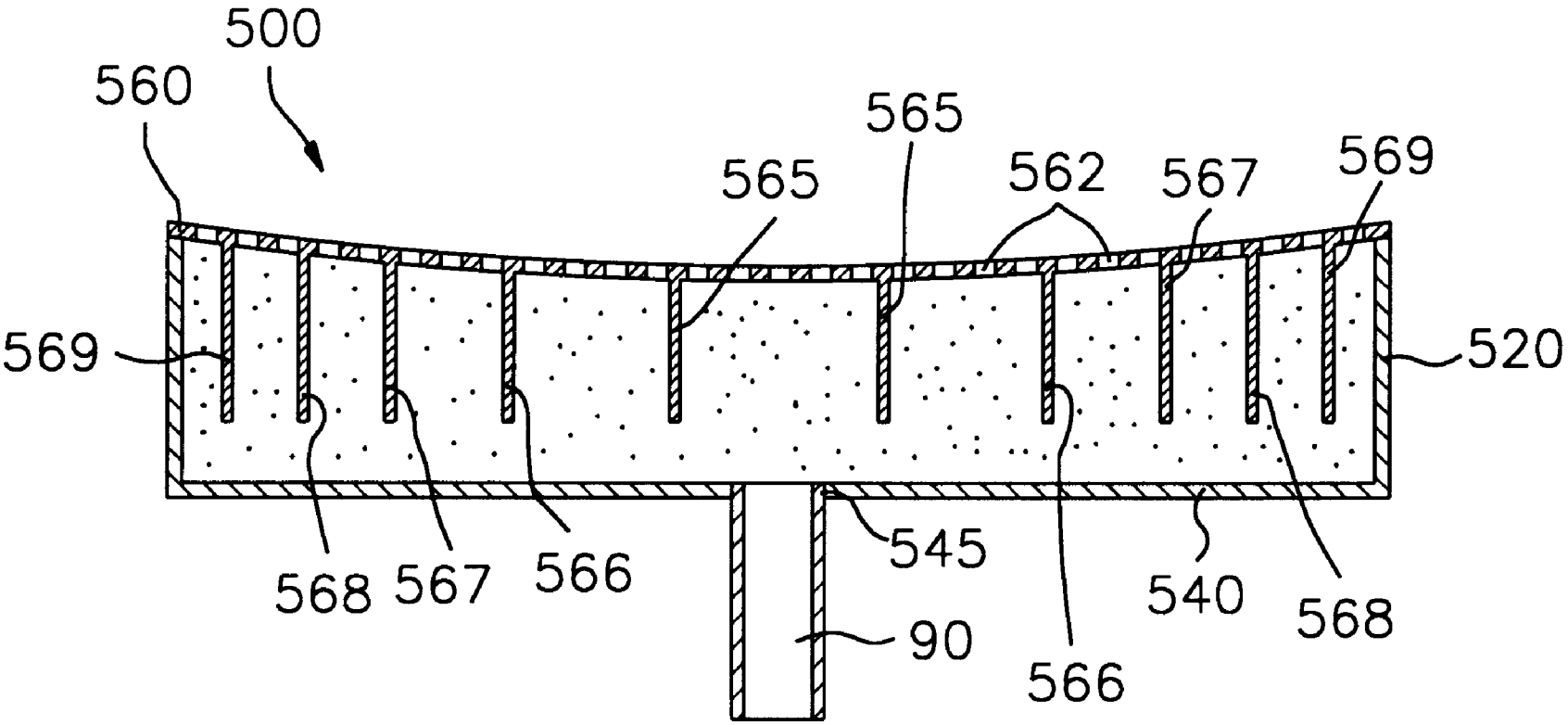
FIG. 11 is a vertically cross-sectioned view of an air bubble generator according to the fifth embodiment of the present invention.

The air bubble generator 400 is constituted with a case 420, a porous member 480, and an air bubble-generating plate (hereinafter, called "a plate") 460. The air bubble generator 400 has space between the case 420 and the plate 460. The porous member 480 is mounted in the space. The bottom 440 of the case 420 has an inlet 445 connected with a conduit 80 which is a passageway of compressed air. The plate 460 has a plurality of through-holes 465. The plate 460 is made with the same process as the first embodiment. The porous member 480 has an array of pairs of compartments, that is, a first pair of compartments 481, 481, a second pair of compartments 482, 482, a third pair of compartments 483, 483, a fourth pair of compartments 484, 484, and a fifth pair of compartments 485, 485. The porous member 480 is divided by the first section E, the second section F, the third section G, the fourth section H, and the fifth section I. Each lower end of the compartments is spaced apart in a uniform distance from the bottom 440 of the case 420. Each upper end, that is, the upper portions of the compartments are contacted with the lower surface of the plate 460 and contacted between the columns of the through-holes 465. The upper portions of the compartments are arranged to have the same distance from the shaft of the drum. Each interval between the compartments is determined for air bubbles to be evenly generated from the plate 460. An interval g1 between the first compartment 481 and the second compartment 483 is larger than an interval g2 between the second compartment 482 and the third compartment 483. The interval g2 between the second compartment 482 and the third compartment 483 is larger than an interval g3 between the third compartment 483 and the fourth compartment 484. The interval g4 between the fourth compartment 484 and the fifth compartment 485 is smaller than the interval g3 between the third compartment 483 and the fourth compartment 484. As shown in FIG. 10, Areas of the sections become smaller and smaller in the direction from the center portion to the edge portion of the plate 460, so that the number of through-holes of each section becomes smaller.

Operations and effect of the air bubble generator 400 according to the fourth embodiment of the present invention will be described hereinafter.

Air from an air compressor (not shown) flows in the air bubble generator 400 through the conduit 80. The air in the air bubble generator 400 passes through the porous member 480 sunk in the washing water up to the plate 460. The air in the air bubble generator 400 flows into the sections formed under the plate 460 by the compartments 481, 482, 483, 484, and 485. That is, most of the air in the air bubble generator 400 (hereinafter, called "generator 400") moves in the first section E, and the rest of the air moves into the other sections. As the air in the first section E reaches the lower surface of the plate 460, a part of the air passes through the through-holes 465 in the shape of air bubbles into the washing water, and the rest of the air moves into the second section F along the first compartment 481. A part of the air in the second section F passes through the through-holes 465 as air bubbles, and the rest moves along the third compartment 483. As mentioned above, the air in the generator 400 is distributed by the compartments into each of the sections and comes out of the through-holes 465 of the plate 460. Accordingly, air bubbles are evenly generated throughout the plate 460.

The Fifth Embodiment

Figure 12:
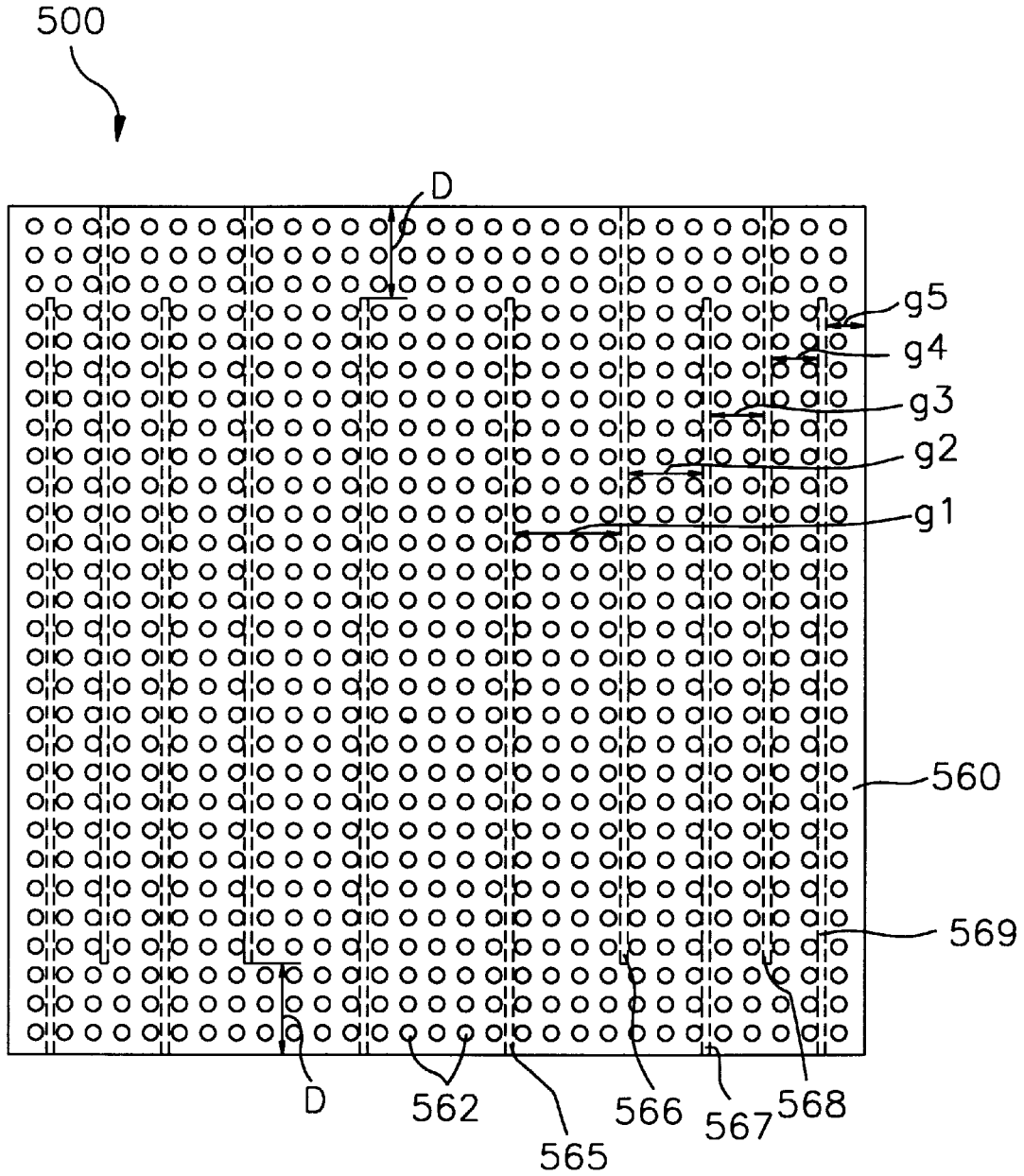
FIG. 12 is a top view of an air bubble-generating plate according to the fifth embodiment of the present invention.

The air bubble generator 500 (hereinafter, called "generator 500") is constituted with a case 520 and an air bubble-generating plate (hereinafter, called "plate") 560. The generator 500 has space between the case 520 and the plate 560. The space is filled with washing water during washing process. The bottom 540 of the case 520 has an inlet 545 connected with a conduit 90 which is a passageway of compressed air. The plate 560 has a plurality of through-holes 565. The plate 560 is made with the same process as the first embodiment. The plate 560 has a plurality of ribs (hereinafter, called "the ribs") protruded toward the bottom 540. Each of the ribs protrudes from between the columns of the through-holes 565. The upper ends, that is, the upper portions of the ribs, are arranged to have the same distance from the shaft of the drum. Intervals between the ribs are determined for air bubbles to be evenly generated from the plate 560. The ribs are constituted with the first ribs 565, the second ribs 566, the third ribs 567, the fourth ribs 568, and the fifth ribs 569. Each of the ribs is spaced apart in the same distance from the bottom 540. The interval between the first rib 565 and the second rib 566 is larger than the interval between the second rib 566 and the third rib 567. The interval between the second rib 566 and the third rib 567 is larger than the interval between the third rib 567 and the fourth rib 568. The interval between the fourth rib 568 and the fifth rib 569 is smaller than the interval between the third rib 567 and the fourth rib 568. As shown in FIG. 12, all the ribs have the same length. One ends of the first, second, and third ribs 565, 567, and 569 are spaced apart in a certain distance D from one edge of the plate 560 to thereby form first air non-blocking portions, and the other ends of the first, second, and third ribs 565, 567, and 569 are just fit to the other edge of the plate 560 when the first, second, and third ribs are contacted to the plate 560, that is, contacted to the lower surface of the plate 560. The second and fourth ribs 566 and 568 are spaced apart in a certain distance D from the other edge to thereby form second air non-blocking portions, which is opposite to the one edge, and contacted to the lower surface of the plate 560.

Operations and effect of the air bubble generator 500 according to the fifth embodiment of the present invention will be described hereinafter.

Air from an air compressor (not shown) flows in the generator 500 through the conduit 90. The air in the generator 500 passes through washing water in the case 520 up to the plate 560. The air from the inlet 545 is distributed due to the ribs 565, 566, 567, 568, and 569 into sections under the plate 560. That is, most of the air from the inlet 545 moves toward the plate 560. As the air reaches the lower surface of the plate 560, a part of the air passes through the through-holes 565 of the plate 560 in air bubbles into the washing water, and the rest of the air moves to the second rib 566 through first air non-blocking portion of the distance D formed between one end of the first rib 565 and one edge of the plate 560. A part of the air flowing in from the first rib 565 into the second rib 566 comes out of the through-holes in air bubbles, and the rest of the air moves into the third rib 567 through the second air non-blocking portion of the distance D formed between one end of second rib 566 and another edge of the plate 560. As mentioned above, the air from the inlet 545 flows into each of the sections through the first and second air non-blocking portions formed between edges of the plate and one ends of ribs. The air in each section comes out of the through-holes 565 of the plate 560 into washing water.

In the air bubble generator according to the fifth embodiment of the present invention, air from the inlet 565 flows along the lower surface of the plate 560 through the first and second air non-blocking portions formed in a zigzag manner. Accordingly, air bubbles are evenly generated throughout the plate 560.

In the meantime, even in the second and fourth embodiments, ribs may protrude from the lower surface of the air bubble-generating plate without using any porous member.

It is understood that various other modifications will be apparent to and can be readily made by those skilled in the art without departing from the scope and spirit of this invention. Accordingly, it is not intended that the scope of the claims appended thereto be limited to the descriptions set forth herein, but rather that the claims be constructed as encompassing all the features of the patentable novelty that resides in the present invention, including all the features that would be treated as equivalent thereof by those skilled in the art to which this pertains.

What is claimed is:

1. A washing machine with an air bubble generator for generating air bubbles from air into washing water in a washer tub, the washing machine having a rotary drum for washing, the air bubble generator comprising:

an open box-type case haivng an inlet in the botton thereof for providing a passageway of compressed air and space therein for accommodating the compressed air;

a porous member for providing the accommodated compressed air with passageways, the porous member having five pairs of compartments protruding from the lower surface of the plate, one end of the five pairs of compartments being spaced apart from the bottom of the case in the same distance, the intervals between the five pairs of compartments becoming less in directions from a center portion to opposite edge portions of the plate; and a plate fixedly covering the open-box type case, having through-holes therein, and having the same curvature as the curvature of the rotary drum, and for providing air bubbles in the washing water.

* * * * *